US005974352A

United States Patent [19]

Shull

[11] Patent Number: 5,974,352

[45] **Date of Patent: *Oct. 26, 1999**

[54] SYSTEM AND METHOD FOR AUTOMATIC BUCKET LOADING USING FORCE VECTORS

[75] Inventor: Andrew G. Shull, Washington, Ill.

[73] Assignee: Caterpillar Inc., Peoria, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 08/779,193

[22] Filed: Jan. 6, 1997

[51] Int. Cl.[6] ..... G06F 7/70

[52] U.S. Cl. ..... 701/50; 37/348; 37/443; 172/4.5; 414/699

[58] Field of Search ..... 701/1, 49, 50; 172/4.5, 9; 37/347, 348, 443; 414/694, 699, 708

[56] References Cited

U.S. PATENT DOCUMENTS

| | | | |
|---|---|---|---|
| 3,782,572 | 1/1974 | Gautier | 214/762 |
| 4,518,044 | 5/1985 | Wiegardt et al. | 701/50 |
| 5,065,326 | 11/1991 | Sahm | 364/424.07 |
| 5,404,661 | 4/1995 | Sahm et al. | 37/348 |
| 5,438,771 | 8/1995 | Sahm et al. | 37/348 |
| 5,446,980 | 9/1995 | Rocke | 37/348 |
| 5,461,803 | 10/1995 | Rocke | 37/443 |
| 5,493,798 | 2/1996 | Rocke et al. | 37/348 |
| 5,528,843 | 6/1996 | Rocke | 37/348 |

OTHER PUBLICATIONS

PCT Application—WO 95/33896 Sensor Feedback Control For Automated Bucket Loading.

*Primary Examiner*—Jacques H. Louis-Jacques
*Assistant Examiner*—Gertrude Arthur
*Attorney, Agent, or Firm*—Steven G. Kibby; Kevin M. Kercher

[57] ABSTRACT

An electrohydraulic control system for loading a bucket of a work machine includes sensors for producing signals representative of bucket position and forces. A command signal generator receives the signals and calculates a target angle on the basis of accumulated energy, and a force vector angle representing actual forces produced at an reference point on the bucket. Lift and tilt command signals are modified in response to differences between the target and actual angles, and used to controllably extend the lift cylinder to raise the bucket through the material, while racking the bucket at rates calculated to efficiently capture the material.

20 Claims, 4 Drawing Sheets

SYSTEM AND METHOD FOR AUTOMATIC BUCKET LOADING USING FORCE VECTORS

TECHNICAL FIELD

This invention relates generally to a control system for automatically controlling a work implement of an earthworking machine and, more particularly, to an electrohydraulic system that controls the hydraulic cylinders of an earthworking machine to adjust the magnitude of command signals responsive to a force vector when capturing material.

BACKGROUND ART

Work machines for moving mass quantities of earth, rock, minerals and other material typically comprise a work implement configured for loading, such as a bucket controllably actuated by at least one lift and one tilt hydraulic cylinder. An operator manipulates the work implement to perform a sequence of distinct functions. In a typical work cycle for loading a bucket, the operator first maneuvers close to a pile of material and levels the bucket near the ground surface, then directs the machine forward to engage the pile.

The operator subsequently raises the bucket through the pile, while at the same time "racking" (tilting back) the bucket in order to capture the material. When the bucket is filled or breaks free of the pile, the operator fully racks the bucket and lifts it to a dumping height, backing away from the pile to travel to a specified dump location. After dumping the load, the work machine is returned to the pile to begin another work cycle.

It is increasingly desirable to automate the work cycle to decrease operator fatigue, to more efficiently load the bucket, and where conditions are unsuitable for a human operator. Conventional automated loading cycles however, using predetermined position or velocity command signals, may be inefficient and fail to fully load the bucket due to the wide variation in material conditions. Pieces of interlocking broken rock left by blasting, referred to herein as "shot rock", and sedimentary earth, referred to herein as "hard pack", present particularly challenging material conditions. Power limitations of the machine hydraulic system may even make conventional automatic loading impossible when the bucket tip encounters larger rocks.

U.S. Pat. No. 3,782,572 to Gautler discloses a hydraulic control system which controls a lift cylinder to maintain wheel contact with the ground, by monitoring associated wheel torque. U.S. Pat. No. 5,528,843 to Rocke discloses a control system for capturing material which selectively supplies maximum lift and tilt signals in response to sensed hydraulic pressures. International Application No. WO 95/33896 to Daysys et al. discloses reversing the direction of fluid flow to the hydraulic cylinder to when bucket forces exceed allowable limits. None of the systems however, variably control the magnitude of the command signals in order to more efficiently capture material.

The present invention is directed to overcoming one or more of the problems as set forth above.

DISCLOSURE OF THE INVENTION

Accordingly, it is an object of the present invention to provide automated loading by a work implement.

It is another object to provide signals for controlling a bucket to capture material, particularly shot rock and hard bank.

It is still another object to provide an automated work cycle for an implement which increases productivity over a manual loading operation.

These and other objects may be achieved with an automatic control system constructed according to the principles of the present invention for loading material using a work implement in accordance with a target angle. In one aspect of the present invention, the system includes sensors that produce signals in response to the positions and forces associated with loading the bucket of a wheel loader. A command signal generator receives the signals and generates a force vector angle representing the direction of machine or material forces acting on the bucket, compares the force vector angle to a target angle, and produces lift and tilt command signals in response to the comparison. Finally, an implement controller receives the lift command signals and controllably extends the lift cylinder to raise the bucket through the material, and receives the tilt command signals and controllably moves the tilt cylinder to tilt the bucket to capture the material.

Other details, objects and advantages of the invention will become apparent as certain present embodiments thereof and certain present preferred methods of practicing the same proceeds.

BRIEF DESCRIPTION OF THE DRAWINGS

A more complete appreciation of this invention may be had by reference to the following detailed description when considered in conjunction with the accompanying drawings in which like reference symbols indicate the same or similar components, wherein.

BEST MODE FOR CARRYING OUT THE INVENTION

Figure 1:
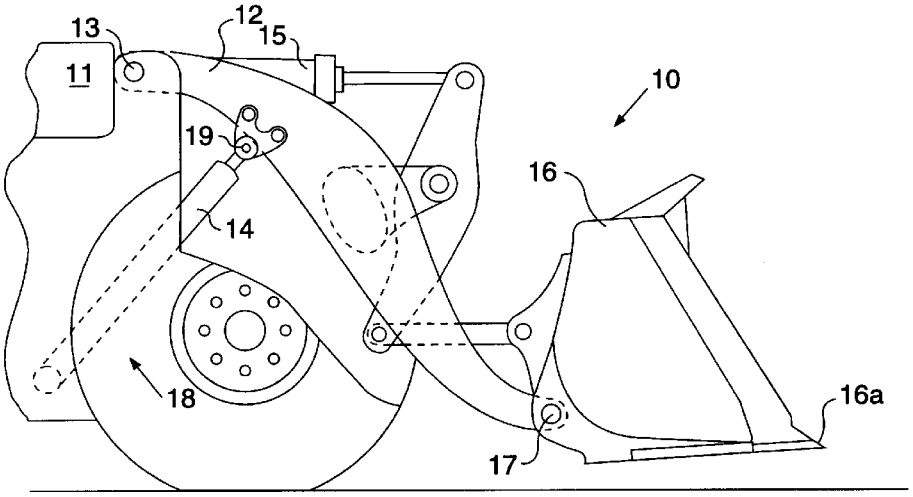
FIG. 1 schematically illustrates a wheel loader and corresponding bucket linkage.

Turning now to the drawings and referring first to FIG. 1, a forward portion of a wheel-type loader machine 10 is shown having a work implement comprising bucket 16 connected to a lift arm assembly 12 and having a bucket tip 16*a*. The lift arm assembly 12 is pivotally actuated by hydraulic lift cylinder 14 about lift arm pivot pins 13 attached to the machine frame 11. Lift arm load bearing pivot pins 19 are attached to the lift arm assembly 12 and the lift cylinder 14. The bucket 16 is tilted back or "racked" by a bucket tilt hydraulic cylinder 15 about bucket pivot pins 17. Although illustrated with respect to a loader moveable by wheels 18, the present invention is equally applicable to other machines such as track-type loaders and other work implements for capturing material.

Figure 2:
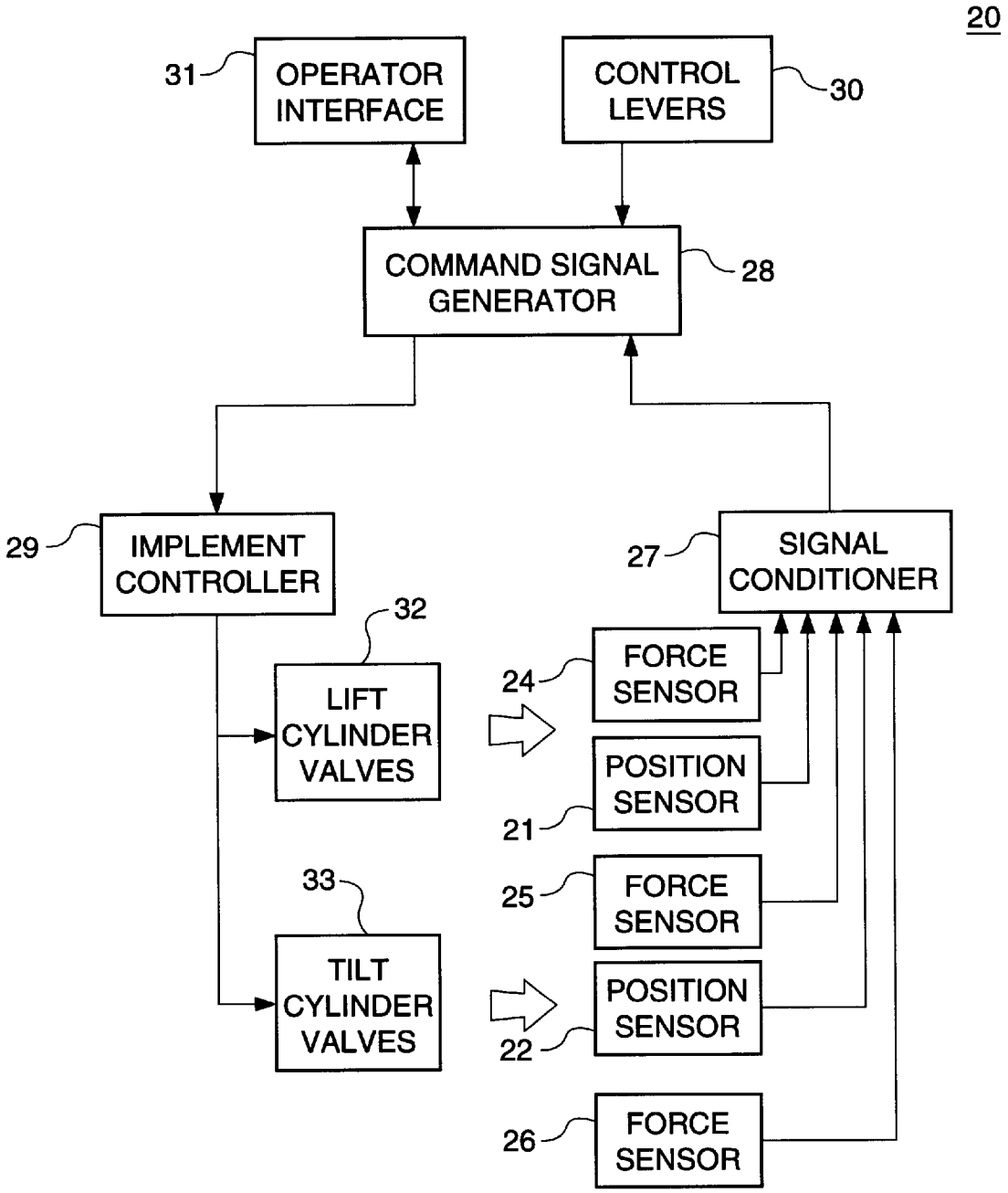
FIG. 2 shows a block diagram of an electrohydraulic system used to automatically control the bucket linkage.

FIG. 2 is a block diagram of an electrohydraulic control system 20 according to one embodiment of the present invention. Lift and tilt position sensors 21 and 22, respectively, produce position signals in response to the position of the bucket 16 relative to the frame 11 by sensing the piston rod extension of the lift and tilt hydraulic cylinders 14,15 respectively. Radio frequency resonance sensors such as those disclosed in U.S. Pat. No. 4,737,705 to Bitar et al. may be used for this purpose, or alternatively the position can be directly derived from work implement joint angle measurements using rotary potentiometers, yo-yos or the like to measure rotation at pivot pins 13 and 17.

Force sensors 24,25 and 26 produce signals representative of the forces exerted on the bucket 16, either by the machine 10 or the equivalent opposing resistance of the material being loaded. The signals are preferably based upon sensed hydraulic pressures in the lift and tilt hydraulic cylinders. The lift cylinder is not retracted during loading, therefore a sensor is provided only at the head end of the cylinder, which is typically oriented to provide upward movement. Sensors are preferably provided at both head and rod ends of the tilt cylinder however, in order to permit force determinations during both racking and unracking of the bucket. The pressure signals are converted to corresponding force values through multiplication by a gain factor representative of the respective cross-sectional areas A of the piston ends. The representative tilt cylinder force $F_T$ corresponds to the difference between the product of the head end pressure and area and the product of the rod end pressure and area:

$$F_T = P_H{}^*A_H - P_R{}^*A_R$$

In an alternative embodiment, hydraulic pressure sensors may be replaced by load cells or similar devices for producing signals representative of mechanical forces acting at joints on the work implement.

The position and force signals may be delivered to a signal conditioner 27 for conventional signal excitation and filtering, but are then provided to the command signal generator 28. The command signal generator 28 is preferably a microprocessor-based system which utilizes arithmetic units to generate signals mimicking those produced by multiple joystick control levers 30 according to software programs stored in memory.

By mimicking command signals representative of desired lift/tilt cylinder movement direction and velocity conventionally provided by control levers 30, the present invention advantageously can be retrofit to existing machines by connection to implement controller 29 in parallel with, or intercepting, the manual control lever inputs. Alternatively, an integrated electrohydraulic controller may be provided by combining command signal generator 28 and a programmable implement controller 29 in to a single unit in order to reduce the number of components.

A machine operator may optionally enter control specifications, such as material condition settings discussed hereinafter, through an operator interface 31 such as an alphanumeric key pad, dials, switches, or a touch sensitive display screen.

The implement controller 29 includes hydraulic control circuitry to open and close valves 32,33 for controlling the hydraulic flow to the respective lift and tilt hydraulic cylinders in proportion to received command signals in a manner well known to those skilled in the art.

In operation, the command signal generator 28 controls bucket movement based upon differences between a calculated target angle and the angle of a force vector representative of actual forces acting at a point on the bucket, derived from received bucket position and force signals using known geometry of the work implement.

The work machine typically moves forward on wheels 18 during the work cycle, therefore additional values are sensed representative of machine ground speed S and drive line torque generated by the work machine. Torque T supplied to the wheels 18 is a function of the ratio of sensed values representative of engine speed and torque converter output speed for an automatic transmission, and may be derived using a look up table. Machine speed S may be directly sensed at an axle or transmission output, but is preferably translated from the torque converter output speed based upon a known transmission shift lever position.

Figure 3:
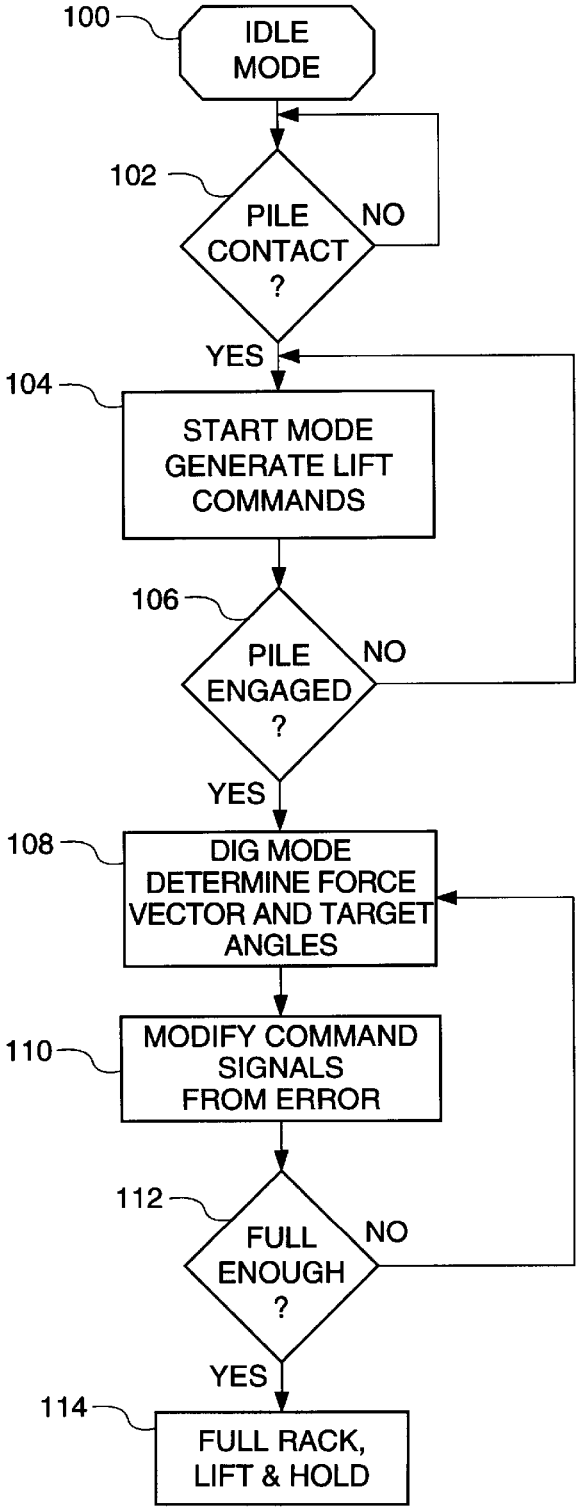
FIG. 3 is a flowchart of program control to automatically capture material.

FIG. 3 is a flow chart of a present preferred embodiment of the invention which may be implemented in program logic performed by command signal generator 28. In the description of the flowchart, the functional explanation marked with numerals in angle brackets, <nnn>, refers to blocks bearing that number.

The program control initially begins at a step <100> when a MODE variable is set to IDLE. MODE will be set to IDLE in response to the operator actuating a switch for enabling automated bucket loading control and substantially leveling the bucket near the ground surface. A bucket position derived from lift and tilt cylinder or pivot pin position signals are used to determine whether the bucket floor is substantially level, such as within plus or minus ten degrees of horizontal at a given lift height. Additional sensed values which may be monitored to ensure that automatic bucket loading is not engaged accidentally or under unsafe conditions include:

- Machine speed within a specified range, such as between one third top first gear speed and less than top second gear speed.
- Control levers 30 substantially in a centered, neutral position, (a slight downward command may be allowed to permit floor cleaning).
- Transmission shift lever in a low forward gear, eg. first through third.

The operator then directs the machine into the pile of material, preferably at close to full throttle, while the program control monitors torque T or lift cylinder force $F_L$ to determine when the machine has contacted the pile <102>. MODE is set to START <104> when command signal generator 28 determines that the torque level has exceeded a set point A and continues to increase while machine ground speed is decreasing. Once in the START MODE, command signal generator 28 optionally sends a downshift command to a transmission controller to cause the transmission to be placed in a lower gear by an automatic downshift routine (not shown), in order to match machine characteristics to the desired aggressiveness or material condition. In the START MODE <104>, a maximum lift command signal is generated in order to cause the implement controller 29 to extend the lift cylinder at maximum velocity and begin lifting the bucket through the pile, thereby producing sufficient downward force to load the front wheels and maintain traction.

As the bucket is lifted through the material while the machine continues to be driven forward, referred to herein as crowding the pile, the energy E applied to the bucket is accumulated and compared to a set point B to determine when the pile has been fully engaged <106>. Energy E may be calculated as the incremental sums of the horizontal work $\Sigma F_x dx$, vertical work $\Sigma F_y dy$ and rotational work $\Sigma M_\theta d\theta$ at a point on the bucket, such as a pivot pin 17.

The extensions of lift and tilt cylinders 14,15 are indicative of corresponding movement of lift arm assembly 12 and bucket 16, which when combined with hydraulic pressures are also indicative of applied forces at the points of attachment. It is apparent that those forces and movements can similarly be translated and decomposed into horizontal, vertical and rotational component forces and movements at pivot pin 17. An additional horizontal component representing incremental movement of the entire assembly 12 relative to the pile is readily derived from machine torque and speed described above.

It has been found that for the purpose of determining when the bucket has fully engaged the pile, it is sufficient to simply calculate the horizontal work $\Sigma F_x dx$. An accumulated energy level sufficient to infer that the bucket has engaged the pile may be experimentally determined for a particular machine size, but a range of approximately 20–30 Joules in scale model units is believed to accurately predict when the bucket has engaged the pile. A scale model unit relates to a bucket approximately 12" by 4", roughly between one eighth and one twelfth standard wheel loader bucket size. Conversion may be performed by multiplying the scale model units by the cube of the scaling factor.

In place of accumulated energy, torque or lift force alternatively may be continuously compared to a set point C in step <106> to determine when the bucket has fully engaged the pile. In order to insure that the bucket has engaged the pile and that the instaneous torque or lift force reading was not a result of a pressure spike, the program control subsequently determines if the sensed value remains greater than the set point for a given duration after automatic bucket loading commences.

If accumulated energy does not yet exceed a set point B, or torque or lift force do not exceed a set point C for a given duration, command signal generator 28 returns to step 104 and continues to generate a lift command. Otherwise, MODE is set to DIG in step 108 and command signal generator 28 begins calculating the angle of a force vector corresponding to the actual forces acting at a reference point P on the bucket tip 16*a*.

Figure 4:
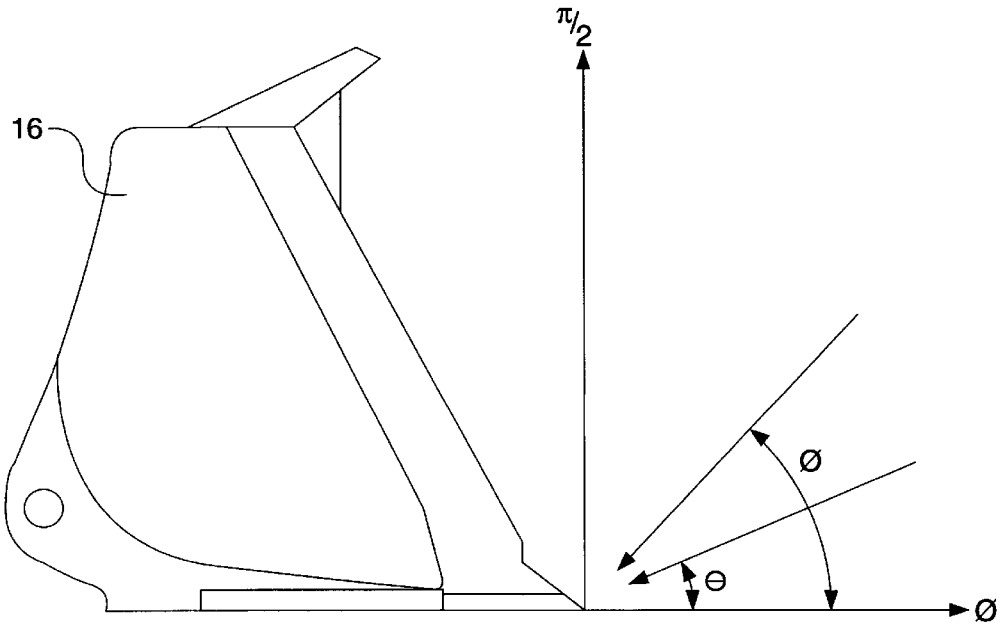
FIG. 4 is a schematic diagram illustrating a respective target angle and force vector angle representative of the composite direction of forces acting on the bucket.

With reference to FIG. 4, the direction and magnitude of a force vector 50 representing digging resistance acting on a reference point P is treated as being equal and opposite to a force vector acting on the same point derived from wheel torque and lift and tilt cylinder pressures and extensions. The aforementioned calculation of an actual force vector involves translation of the several forces acting through lift arm assembly 12 on the bucket 16 to a reference point, and resolution into their component parts. The precise computations are dependent on the particular machine configuration, but are considered to be within the level of ordinary skill in the art and will not be set forth herein.

In order to facilitate explanation of the present invention, a horizontal force vector relative to either the bucket floor or machine chassis, is defined herein as having an angle 0, whereas a vertical force vector is defined as having an angle of $\pi/2$ radians. In step <110>, the command signal generator 28 produces an error signal $\theta_{ERR}$ by subtracting a target angle $\theta_T$ from the vector angle $\theta_F$ calculated from the actual forces. The error signal is then multiplied by a gain factor to modify the velocity command signals provided to controller 29 for positioning the valves 32,33 supplying hydraulic fluid to the lift and tilt cylinders 14,15. The target angle $\theta_T$ is continually increased as a function of the accumulated energy E as described below, in order to quickly respond to changes in the digging conditions.

In the present preferred embodiment, when the target angle $\theta_T$ is less than the actual force vector angle $\theta_F$, the tilt cylinder velocity command signal for racking the bucket is increased by the square of the error signal $\theta_{ERR}$, multiplied by a gain factor $K_1$. This form of tilt correction tends to rapidly correct large differences while virtually ignoring small ones. The lift cylinder velocity command signal, on the other hand, is decreased by subtracting the error signal $\theta_{ERR}$ multiplied by a gain factor $K_2$ from a predetermined constant lift velocity signal. If the target angle $\theta_T$ is greater than the vector angle $\theta_F$, the tilt cylinder velocity command signal is decreased while the lift cylinder velocity command signal is increased. This is somewhat counterintuitive in that the bucket tip moves away from the force in order to control it.

The aforementioned tilt velocity command signals are subject to specified maximum limits in order to suppress rapid oscillations. The maximum velocity is preferably determined on the basis of a material condition setting representative of the loading difficult for a particular material to be captured. A relatively low maximum tilt velocity of about 0.2 rad/sec has been determined to be useful for loading shot rock, whereas a maximum tilt velocity of about 0.6 rad/sec has proven more effective for loading pea gravel.

According to an embodiment of the present invention, the target angle $\theta_F$ is linearly increased as function of the accumulated energy according to the relationship:

$$\theta_T = m*E+b$$

where m and b are respective constants selected based upon material condition. For example, a slope of m=0.007 provides a slightly less aggressive approach than a slope of m=0.005 because the target angle changes more rapidly in response to higher digging energies. The intercept b is selected to produce a high initial target angle in loose material for quicker racking. Although the invention has been illustrated using a linear relationship between the target angle and accumulated energy, it is readily apparent that the target angle could instead be calculated using a nonlinear function, or stepwise using a lookup table, without departing from the spirit of the present invention.

The particular values utilized for the slope m and energy axis intercept b may be selectable by the operator in order to control the aggressiveness of the bucket loading, on the basis of a material condition setting input through switches on operator interface 31. The material condition setting may instead be automatically determined during each work cycle using accumulated energy levels. For example, a default setting for a relatively aggressive loading of loose material may be used initially, having a corresponding relatively low slope m, then modified if the bucket fails to move at least a given distance as accumulated energy increases by a predetermined amount. In this way, the rate at which the target angle increases in proportion to accumulated energy, defined as slope m, would then be increased if the bucket failed to move as expected for a given energy input. In other words, by increasing the slope of the target angle function, the command signal generator 28 "gives up" on tough spots more readily.

While tilt velocity may occasionally have a negative value (unracking), lift velocity is not permitted to fall below zero during the loading portion of the work cycle. Typically, the controller and associated valves are implemented with "tilt priority", which ensures that the tilt cylinder receives from the pump an adequate supply of hydraulic fluid to produce the requested velocity before pressurized fluid is supplied to the tilt cylinder. Consequently, the lift cylinder may not extend at all during portions of the work cycle where the tilt command exceeds some portion of full tilt, despite a lift command having been generated. A stall condition feature activated when the lift pressure exceeds a set point G may optionally set the target angle to $\pi/2$ radians in order to temporarily supply fluid pressure only to the tilt cylinder.

After modifying the lift and tilt velocity command signals, the command signal generator 28 determines in a step 112 whether the bucket is full enough to end the DIG MODE portion of the work cycle. If not, command signal generator 28 returns to step <108> to perform additional iterations of calculating a force vector and target angle to modify the velocity command signals. If in step <112> the bucket 16 is determined to be full enough, then command signal generator 28 produces in step <114> command signals to cause the tilt cylinder to extend at maximum velocity, optionally followed signals to extend the lift cylinder at maximum velocity to a given height up to the maximum extension. Command signal generator 28 determines in step <112> whether the bucket is full enough by comparing the lift and/or tilt cylinder extensions to set points including:

Whether the extension of the tilt cylinder is greater than a set point E, such as 0.75 radians, indicating that the bucket is almost completely racked back.

Whether the extension of the lift cylinder is greater than a set point F, indicating that the bucket has likely broken free of the pile.

Whether a loading time limit has been exceeded.

Whether the operator initiated manual control by moving one of the control levers 30 out of the neutral range.

Additionally, accumulated energy may be checked to determine whether the bucket should be considered full, An accumulated energy level in the range of 80–90 Joules in scale model units has been found to be representative of a full bucket load for rock. If one or more of the above or similar criteria are satisfied, then the bucket is said to be substantially filled.

Alternatively, a MODE of FINISH PHASE may be set in step <114>, whereby the target angle is increased rapidly as a function of both the current bucket angle $\theta_B$ and accumulated energy according to the formula:

$$\theta_T = m*E + b*\theta_B$$

Industrial Applicability

Features and advantages associated the present invention are best illustrated by description of its operation in relation wheel loaders. Once automatic bucket control is first initiated in response to monitored torque levels, the command signal generator monitors drive line torque and forces on the lift and tilt cylinders to determine when the bucket fully engages the pile. Once the pile is fully engaged, the command signal generator sends signals to the controller to continuously vary the angle of attack in response to accumulated energy.

As described, the command signal generator 28 varies the lift and tilt cylinder command signals supplied to the controller within certain maximum values in order to maintain the lift and tilt cylinder forces at an effective angle in response to the digging difficulty encountered. For example, if particular difficulty is encountered at a point during a digging cycle, indicated by a rapid increase in the accumulated energy and consequently in the target angle, the rate at which the bucket is racked will quickly decrease in proportion to the lift rate, so that the command signal generator will more easily give up on a tough portion of the pile rather than continuing to push and penetrate too deeply. At the same time, a rapid decrease in the rate energy is accumulated will tend to decrease the lift rate in proportion to the tilt rate and prevent the bucket from "breaking-out" of the pile too quickly. The present invention is particularly useful for loading shot rock, which tends to interlock along sharp angular edges, and hard bank due to its ability to accommodate widely varying digging conditions.

Figure 5:
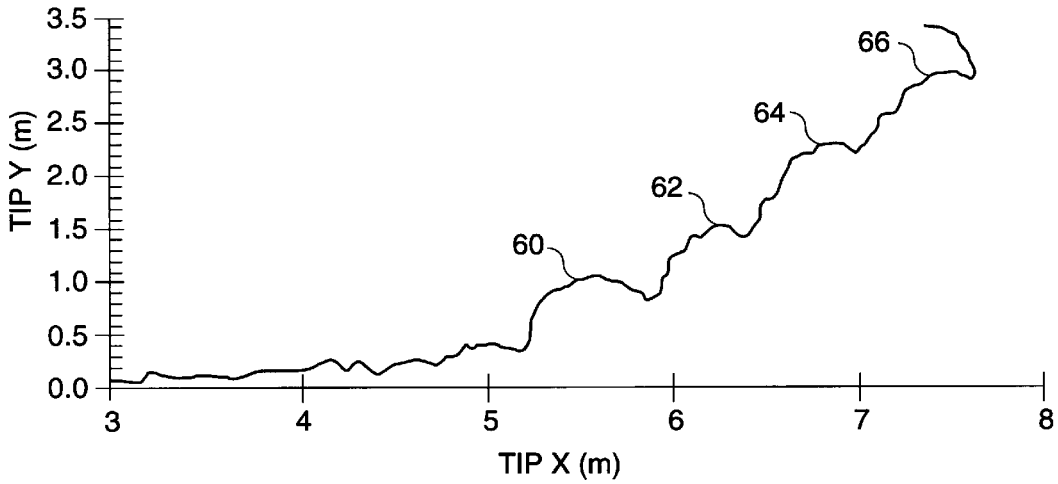
FIG. 5 is a graph illustrating a sample bucket tip path through trap rock according to one embodiment of the present invention.

FIG. 5 illustrates horizontal versus vertical movement corresponding to a sample bucket tip path when loading one inch trap rock according to the present invention. Trap rock simulates on a scaled size the difficult digging conditions encountered when loading interlocking piles of shot rock left by blasting. A series of humps 60, 62, 64 and 66 illustrate the manner in which the present invention "wiggles" the bucket tip responsive to detection of force vector angles to efficiently load the material.

Figure 6:
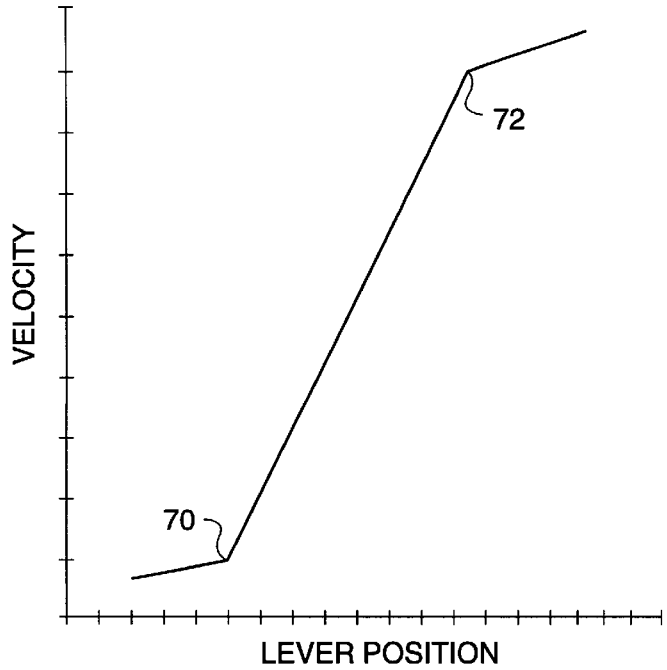
FIG. 6 is a graph illustrating a non-linear velocity response typically found within the range of manual control signals.

FIG. 6 illustrates a non-linear velocity response of implement controller 29 and hydraulic cylinders 14, 15 at the end positions 70,72 of control levers 30. Under manual control, this non-linearity is of little consequence because the operator typically is able to distinguish and react to only gross changes in velocity. In the present invention however, it is desirable to be able to make relatively small, predictable changes to hydraulic cylinder velocity in order to smoothly respond to the actual force vectors. Accordingly, in another aspect of the present invention, implement controller 29 is provided with closed loop control or factory calibration to ensure lift and tilt cylinder response is predictably proportional to velocity commands generated by command signal generator 28.

While certain present preferred embodiments of the invention and certain present preferred methods of practicing the same have been illustrated and described herein, it is to be distinctly understood that the invention is not limited thereto but may be otherwise variously embodied and practiced within the scope of the following claims.

What is claimed is:

1. A control system for automatically controlling a bucket of an earthmoving machine to capture material, the bucket being controllably actuated by a hydraulic lift cylinder and tilt cylinder, the system comprising:

pressure sensing means for producing pressure signals in response to the respective hydraulic pressures associated with the lift and tilt cylinders;

position sensing means for producing position signals representative of the respective extensions of the lift and tilt cylinders;

command signal generating means for receiving the position and pressure signals and responsively computing correlative force vector angles representative of the composite forces acting at a reference point on the bucket, and generating cylinder velocity command signals responsive to error signals produced by subtracting target force vector angles from actual force vector angles; and a hydraulic implement controller for modifying the hydraulic pressures in said cylinders in response to said command signals.

2. A control system, as set forth in claim 1, further comprising said command signal generating means determining when the bucket has contacted a pile of material to be captured, responsively generating cylinder velocity command signals to cause said controller to engage the pile with the bucket, and computing accumulated energy produced by the machine using said pressure signals and changes in said position signals.

3. A control system, as set forth in claim 2, further comprising said command signal generating means computing said target angle as a function of said accumulated energy.

4. A control system, as set forth in claim 1, further comprising said command signal generating means comparing the position signals to a plurality of positional set points, and generating substantially maximum tilt cylinder velocity command signals to fully rack the bucket when the position of one of said lift and tilt cylinders exceed respective positional set points.

5. A control system, as set forth in claim 1, further comprising said command signal generator iteratively modifying cylinder velocity command signals for said tilt cylinder as a function of the square of the difference between said force vector angles and said target angles.

6. A control system, as set forth in claim 1, further comprising said command signal generator generating cylinder velocity command signals for said lift cylinder as a function of the difference between said force vector angles and said target angles offset from a constant lift velocity command signal.

7. A control system for automatically controlling a bucket of an earthmoving machine to capture material, the bucket being controllably actuated by a hydraulic lift cylinder and tilt cylinder, the system comprising:

pressure sensing means for producing pressure signals in response to the respective hydraulic pressures associated with the lift and tilt cylinders;

position sensing means for producing position signals representative of the respective extensions of the lift and tilt cylinders;

command signal generating means for receiving the position and pressure signals and responsively computing correlative force vector angles representative of the composite forces acting at a reference point on the bucket, and generating cylinder velocity command signals responsive to differences between said force vector angles and target angles and determining when the bucket has contacted a pile of material to be captured, responsively generating cylinder velocity command signals to cause said controller to engage the pile with the bucket, and computing accumulated energy produced by the machine using said pressure signals and changes in said position signals and comparing the accumulated energy to at least one set point, and computing said target angle as a function of both bucket angle and said accumulated energy when the accumulated energy exceeds said set point; and a hydraulic implement controller for modifying the hydraulic pressures in said cylinders in response to said command signals.

8. A control system for automatically controlling a bucket of an earthmoving machine to capture material, the bucket being controllably actuated by a hydraulic lift cylinder and tilt cylinder, the system comprising:

pressure sensing means for producing pressure signals in response to the respective hydraulic pressures associated with the lift and tilt cylinders;

position sensing means for producing position signals representative of the respective extensions of the lift and tilt cylinders;

means for selecting a material condition setting;

command signal generating means for receiving the position and pressure signals and responsively computing correlative force vector angles representative of the composite forces acting at a reference point on the bucket, and generating cylinder velocity command signals responsive to differences between said force vector angles and target angles and determining when the bucket has contacted a pile of material to be captured, responsively generating cylinder velocity command signals to cause said controller to engage the pile with the bucket, and computing accumulated energy produced by the machine using said pressure signals and changes in said position signals and computing said target angle as a linear function of said accumulated energy, having a slope and intercept determined by said material condition setting; and a hydraulic implement controller for modifying the hydraulic pressures in said cylinders in response to said command signals.

9. A control system as set forth in claim 8, said means for selecting a material condition setting comprising at least one operator actuated switch.

10. A control system as set forth in claim 8, wherein said means for selecting a material condition setting determines loading difficulty on the basis of distance traveled by the bucket as the accumulated energy increases a predetermined amount.

11. A control system for automatically controlling a bucket of an earthmoving machine to capture material, the bucket being controllably actuated by a hydraulic lift cylinder and tilt cylinder, the system comprising:

pressure sensing means for producing pressure signals in response to the respective hydraulic pressures associated with the lift and tilt cylinders;

position sensing means for producing position signals representative of the respective extensions of the lift and tilt cylinders;

drive line speed sensing means for producing signals representative of drive line speed and torque generated by the machine;

command signal generating means for receiving the position and pressure signals and responsively computing correlative force vector angles representative of the composite forces acting at a reference point on the bucket, and generating cylinder velocity command signals responsive to differences between said force vector angles and target angles and said command signal generating means receiving the position, pressure and torque signals and computing energy levels representative of accumulated energy generated by the work machine; and a hydraulic implement controller for modifying the hydraulic pressures in said cylinders in response to said command signals.

12. A control system for automatically controlling a bucket of an earthmoving machine to capture material, the bucket being controllably actuated by a hydraulic lift cylinder and tilt cylinder, the system comprising:

pressure sensing means for producing pressure signals in response to the respective hydraulic pressures associated with the lift and tilt cylinders;

position sensing means for producing position signals representative of the respective extensions of the lift and tilt cylinders;

command signal generating means for receiving the position and pressure signals and responsively computing correlative force vector angles representative of the composite forces acting at a reference point on the bucket, and generating cylinder velocity command signals responsive to differences between said force vector angles and target angles and determining when the bucket has contacted a pile of material to be captured, responsively generating cylinder velocity command signals to cause said controller to engage the pile with the bucket, and computing accumulated energy produced by the machine using said pressure signals and changes in said position signals; and a means for determining when the bucket has contacted the pile using said drive line torque signals and responsively beginning accumulation of said machine energy levels; and a hydraulic implement controller for modifying the hydraulic pressures in said cylinders in response to said command signals.

13. A control system for automatically controlling a work implement of an earthworking machine to capture material, the work implement including a bucket, the bucket being controllably actuated by a lift hydraulic cylinder and a tilt hydraulic cylinder, comprising:

force sensors for producing signals representative of sensed forces acting on the bucket;

position sensors for producing signals representative of bucket position;

a command signal generator receiving said force signals, computing cumulative force vectors at a reference point on the bucket, and producing lift and tilt cylinder command signals responsive to error signals produced by subtracting target force vector angles from actual force vector angles; and an implement controller for receiving the lift command signals and controllably extending the lift cylinder to raise the bucket through the material, and receiving the tilt command signals and controllably extending the tilt cylinder to tilt the bucket to capture the material.

14. A control system as recited in claim 13, further comprising said command signal generator determining when the bucket has engaged a pile of material to be captured, responsively computing accumulated energy produced by the machine using said force signals and changes in said position signals.

15. A control system, as set forth in claim 14, further comprising said command signal generator computing said target angle as a function of said accumulated energy.

16. A control system, as set forth in claim 15, further comprising said command signal generator iteratively reducing said cylinder velocity command signal for said tilt cylinder when said target angle exceeds said force vector angle.

17. A method for automatically controlling a work implement of an earthworking machine to capture material, the work implement including a bucket, the bucket being controllably actuated by at least one hydraulic lift cylinder and at least one hydraulic tilt cylinder, the method comprising the steps of:

producing hydraulic pressure signals representative of the forces produced by respective lift and tilt cylinders;

producing position signals representative of the position of the bucket;

generating hydraulic cylinder velocity command signals to engage and capture material with the bucket;

calculating the accumulated energy applied by the machine to the bucket;

calculating force vector angles representative of the cumulative forces applied by the machine to the bucket at a reference point; and modifying said hydraulic cylinder velocity command signals responsive to error signals produced by subtracting target force vector angles from actual force vector angles.

18. A method as set forth in claim 17, further comprising said target angles as a function of said accumulated energy.

19. A method as set forth in claim 17, further comprising iteratively reducing said cylinder velocity command signal for said tilt cylinder when said target angle exceeds said force vector angle.

20. A method for automatically controlling a work implement of an earthworking machine to capture material, the work implement including a bucket, the bucket being controllably actuated by at least one hydraulic lift cylinder and at least one hydraulic tilt cylinder, the method comprising the steps of:

producing hydraulic pressure signals representative of the forces produced by respective lift and tilt cylinders;

producing position signals representative of the position of the bucket;

generating hydraulic cylinder velocity command signals to engage and capture material with the bucket;

calculating the accumulated energy applied by the machine to the bucket;

calculating force vector angles representative of the cumulative forces applied by the machine to the bucket at a reference point;

modifying said hydraulic cylinder velocity command signals responsive to differences between said force vector angles and target angles;

selecting a material condition setting; and computing said target angle as a linear function of said accumulated energy, having a slope and intercept determined by said material condition setting.

* * * * *